US006560787B2

(12) United States Patent
Mendoza

(10) Patent No.: US 6,560,787 B2
(45) Date of Patent: May 13, 2003

(54) SAFETY HELMET

(76) Inventor: Irma D. Mendoza, 138 Applewood, Brownsville, TX (US) 78520

( * ) Notice: Subject to any disclaimer, the term of this patent is extended or adjusted under 35 U.S.C. 154(b) by 0 days.

(21) Appl. No.: 09/943,700

(22) Filed: Aug. 31, 2001

(65) Prior Publication Data

US 2002/0023291 A1 Feb. 28, 2002

Related U.S. Application Data

(60) Provisional application No. 60/229,282, filed on Aug. 31, 2000.

(51) Int. Cl.[7] ..... A42B 3/00
(52) U.S. Cl. ..... 2/413; 2/412
(58) Field of Search ..... 2/413, 412, 411, 2/417, 425, DIG. 3

(56) References Cited

U.S. PATENT DOCUMENTS 3,407,406 A * 10/1968 Werner et al. ..... 128/893
3,600,714 A * 8/1971 Cade et al. ..... 2/413
3,946,441 A * 3/1976 Johnson ..... 2/412
3,994,020 A * 11/1976 Villari ..... 2/413
4,064,565 A * 12/1977 Griffiths ..... 2/412
4,307,471 A * 12/1981 Lovell ..... 2/411
5,815,846 A * 10/1998 Calonge ..... 2/413
6,058,515 A * 5/2000 Kitahara ..... 2/412

FOREIGN PATENT DOCUMENTS

EP 48442 * 3/1982
FR 2379262 * 9/1978

* cited by examiner

*Primary Examiner*—Rodney M. Lindsey
(74) *Attorney, Agent, or Firm*—Bracewell & Patterson LLP

(57) ABSTRACT

An improved safety helmets designed and manufactured to protect the head and brain from both linear and rotational impact energy. The helmet designed and manufactured to diffuse or absorb impact energy in a uniform manner around the head and allows for effective reuse of the helmet after multiple impacts. The safety helmet is constructed of layers of polyurethane, monoprene gel, polyethylene and either polycarbonate or polypropylene. The safety helmet manufactured and designed of these materials protect the brain from both linear and rotational impact energy and diffuse or absorb impact energy in a uniform manner around the head.

10 Claims, 3 Drawing Sheets

SAFETY HELMET

PRIOR APPLICATIONS

This Application claims subject matter disclosed in Provisional Application No. 60/229,282, claiming and relying on its filing date of Aug. 31, 2000.

BACKGROUND OF INVENTION

1. Field of Invention:

The present invention relates to the design and safety of bicycle helmets. In particular this invention relates to the order and layering of materials used in safety helmets.

2. Description of the Prior Art:

Bicycling is an international recreational activity and means of transport that maintains a serious risk of head injury. In addition to bicycling other recreational activities including rollerblading, and skateboarding all maintain a serious risk of head injury. Head injury is a leading cause of accidental death and disability among children in the United States, resulting in over 100,000 hospitalizations every year. Studies have shown that children under the age of 14 are more likely to sustain head injuries than adults, and that children's head injuries are often more severe than those sustained by adults. In general, head injuries fall into two main categories—focal and diffuse. Focal injuries are limited to the area of impact, and include contusions, hematomas, lacerations and fractures. Diffuse brain injuries involve trauma to the neural and vascular elements of the brain at the microscopic level. The effect of such diffuse damage may vary from a completely reversible injury, such as a mild concussion, to prolonged coma and death.

Other activities, such as roller skating, in-line skating and skate boarding are typically conducted on the same types of surfaces as bicycling and can generate speeds similar to bicycling. Therefore, similar patterns of injury and benefits of helmet usage can be expected. Similar design considerations would apply for protective helmets for skating activities, in terms of impact attenuation. One difference between bicycling injuries and skating injuries is that, while 90 percent of bicycle-related head injuries occur on the front of the head, 80 percent of skating-related head injuries occur on the back of the head. Consequently, protective helmets for skating activities may have somewhat different design considerations in terms of coverage and location of protective padding. Protective helmets for aquatic activities, such as windsurfing, kayaking or waterskiing, have similar design considerations in terms of impact attenuation, with the additional requirement for moisture resistance during long-term immersion. Protective helmets for some activities, such as skiing or mountaineering, in addition to impact attenuation, have a need for a broad range of service temperatures.

The use of safety helmets with these various activities has increased; however the incidents of fatalities and injuries have not decreased. An accident, primarily bicycling accidents, result in both linear and rotational injury to be impressed on the brain and can result in contrecoup injuries, intracranial hemorrhages, and concussions. Severe brain damage is caused when the brain is deformed by a non uniform or point of impact pressure to the head. If the pressure to the head is uniform or surrounding the entire brain area, the brain will not be permanently injured. Currently marketed safety helmets are designed and manufactured for direct energy absorption. Current helmets are designed with a hard outer shell (Acrylonitrile-Butadiene-Styrene) and padded layer (expanded polypropylene) for energy absorption from direct, linear impact. The currently available helmets in the market do not provide protection from rotational energy impact or diffuse impact energy to the entire skull area to create uniform skull pressure.

SUMMARY OF INVENTION

Briefly, the present invention generally relates to protective safety helmets, particularly, this invention provides for a safety helmet designed and manufactured to protect the head and brain from both linear and rotational impact energy. Additionally, this invention is designed and manufactured to diffuse or absorb impact energy in a uniform manner around the head. Additionally, the present invention provides for a design that permits the safety helmet to be constructed of material that allows the safety helmet to be effectively reused after multiple impacts. The present invention is a safety helmet constructed of layers of polyurethane, monoprene gel, polyethylene, and either polycarbonate or polypropylene. The safety helmet manufactured and designed of these materials protects the brain from both linear and rotational impact energy and diffuses or absorbs impact energy in a uniform manner throughout the helmet and over a larger surface of the wearer's head.

DESCRIPTION OF THE PREFERRED EMBODIMENT

Figure 1:
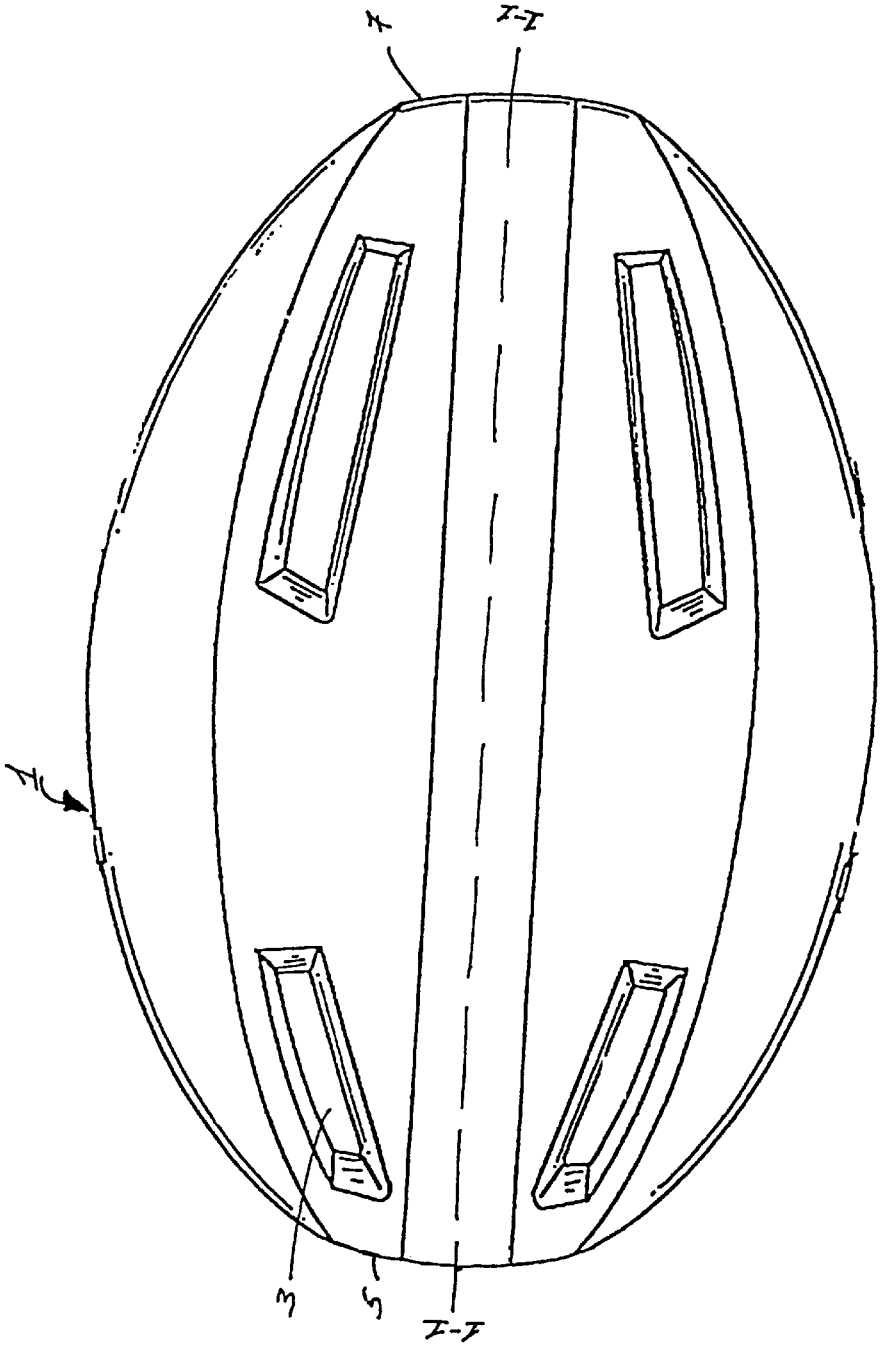
FIG. 1 is a top view of the safety helmet.
Figure 2:
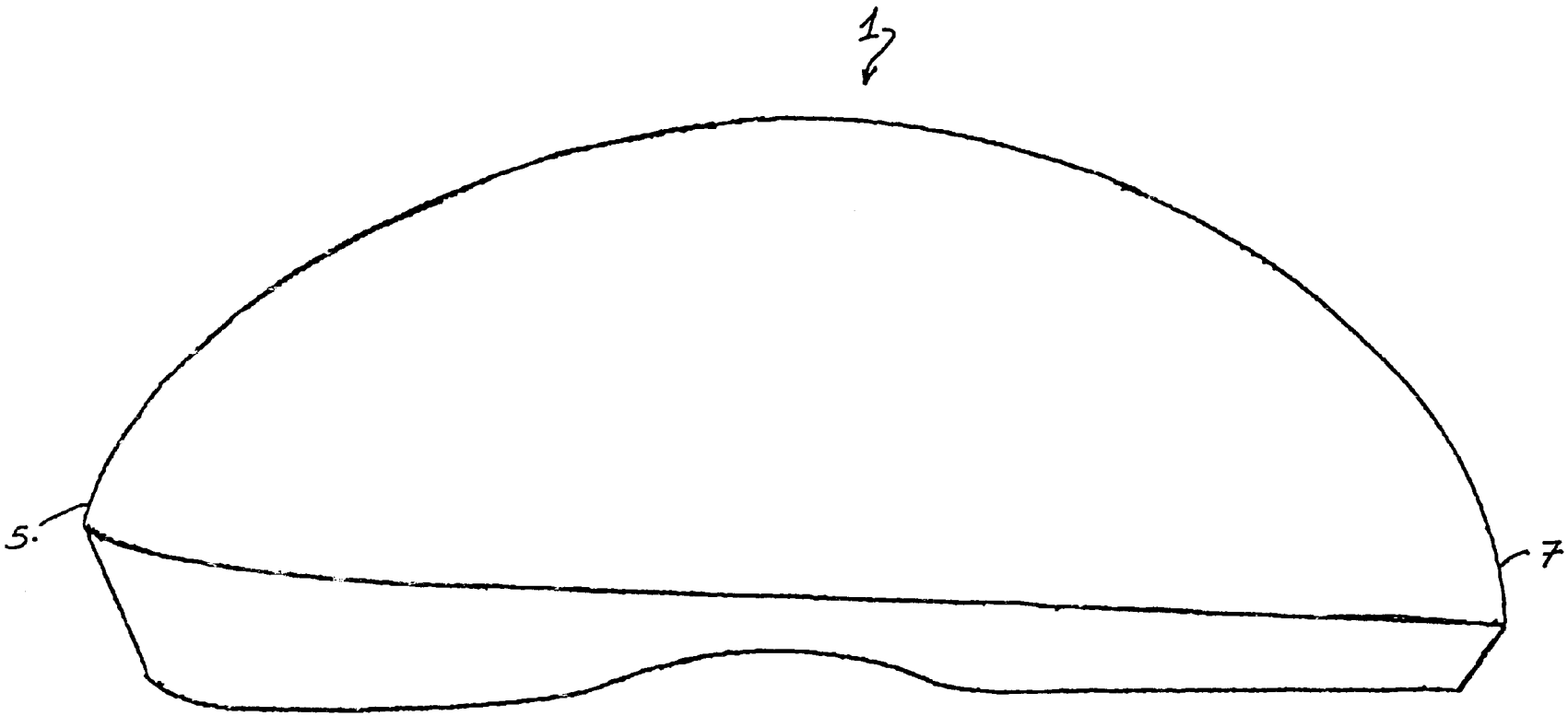
FIG. 2 is a right side view of the safety helmet.
Figure 3:
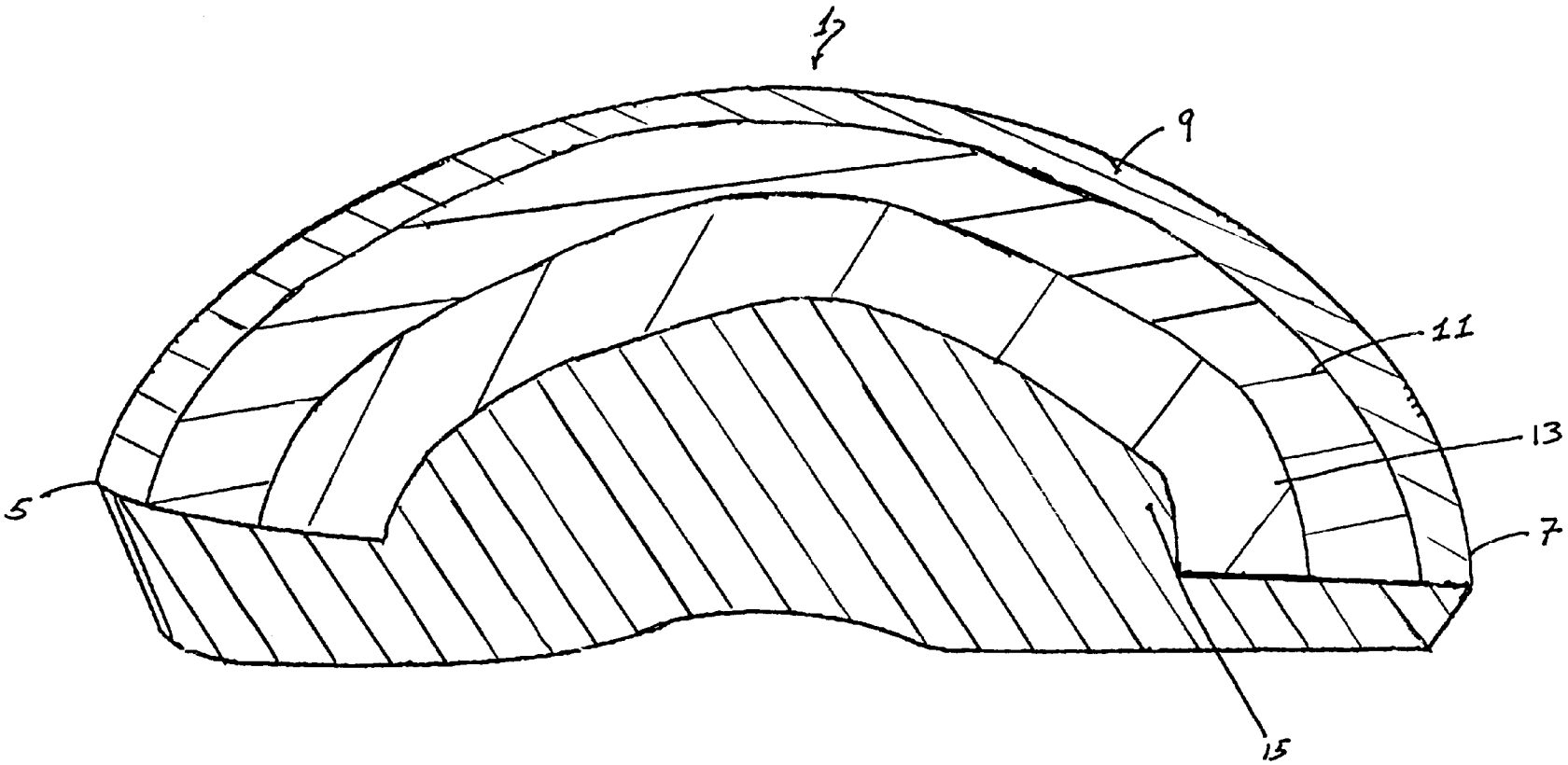
FIG. 3 is a cross section of the safety helmet.

In the drawings, FIG. 1 is a top view of the safety helmet 1 for bicycle riders constructed in accordance with the present invention. FIG. 2 is a right side view of the safety helmet 1 for bicycle riders constructed in accordance with the present invention. FIG. 3 is an cross section of the right side view of the safety helmet 1 along line 1—1 of FIG. 1 for bicycle riders constructed in accordance with the present invention. The safety helmet 1 is preferably made with a streamlined aerodynamic shape, such as the one shown in this illustrative example. The helmet 1 has ventilation holes 3 in the front 5 and back 7 of the helmet 1 to allow cooling air to circulate through the helmet 1. The helmet 1 may also include a chin strap or other retention system (not shown) for fastening the helmet 1 on the rider's head. The preferred embodiment of helmet 1 is designed to provide the wearer with unobstructed peripheral vision to at least 105 degrees on each side of the midsagittal plane and with protective coverage on at least the front, side and top portions of the head. When intended for use in other sports, such as roller skating, in-line skating and skate boarding, the helmet 1 can be designed with increased protective coverage on the back of the head consistent with the head injury patterns observed for those sports.

In a preferred embodiment, the safety helmet 1 of the present invention has a helmet shell 9 made of a laminated, polymeric material. FIG. 3 shows a longitudinal cross section of the helmet 1 taken along line 1—1 in FIG. 1. An inner layer 11 of the helmet 1 is made of a polyurethane material, for absorption of impacts and for distributing the stress of a impact over a larger surface of the wearer's head to lessen the likelihood of injury. A second inner layer 13 is made of soft gel, for absorption of impacts to the helmet 1, for absorption and diffusion of stress through the helmet 1, over a larger surface of the wearer's head to lessen the likelihood of injury. A third layer 15 in contact with the wearer's head is made of a polyethylene material that will be used to absorb the gel layer 13 in circumstances of puncture, will aid in the comfort of the fit of the helmet 1, will absorb and diffuse impact energy, and will distribute stress of an impact through the helmet 1 over a larger surface of the wearer head to lessen the likelihood of injury.

In the preferred embodiment helmet shell 9 is constructed of polypropylene. The thickness of the polypropylene shell may be varied, pursuant to what is need in the industry and consumer market. However, a thickness of 1/16 inch was determined to be the most effective and preferred in absorption and diffusion of linear and rotational impact energy in a uniform manner throughout the helmet 1 and over a larger surface of the wearer's head. A helmet shell 9 constructed of 1/8 inch polypropylene was determined to be the effective helmet shell 9 in absorption and diffusion of linear and rotational impact energy in a uniform manner throughout the helmet 1 and over a larger surface of the wearer's head. A helmet shell 9 constructed of 1/16 Acrylonitrile-Butadiene-Styrene(ABS)/polycarbonate was determined to be the effective helmet shell 9 in absorption and diffusion of linear and rotational impact energy in a uniform manner throughout the helmet 1 and over a larger surface of the wearer's head. A helmet shell 9 constructed of 1/8 AcrylonitrileButadiene-Styrene(ABS)/polycarbonate was determined to be effective in absorption and diffusion of linear and rotational impact energy in a uniform manner throughout the helmet 1 and over a larger surface of the wearer's head.

In the preferred embodiment inner layer 11 is constructed of polyurethane. The thickness and the type of polyurethane may be varied, pursuant to the needs in the industry, consumer market, and use of the helmet. In the preferred embodiment a polyurethane layer of ½ inch thickness was determined to be the most effective in absorption and diffusion of linear and rotational impact energy in a uniform manner throughout the helmet 1 and over a larger surface of the wearer's head.

In the preferred embodiment the second inner layer 13 is constructed of gel. The gel provides the majority of the absorption and diffusion of linear and rotational impact energy in a uniform manner throughout the helmet 1 over a larger surface of the wearer's head. Additionally, the gel permits the reuse of the helmet 1 after multiple impacts due to it ability to maintain its structural integrity due to the manner in which it absorbs and diffuses the linear and rotational impact energy. The thickness and the type of gel may be varied, pursuant to the needs in the industry, consumer market, and use of the helmet. In the preferred embodiment, a monoprene gel of ½ inch thickness was determined to be the most effective in absorption and diffusion of linear and rotational impact energy in a uniform manner throughout the helmet 1 and over a larger surface of the wearer's head.

In the preferred embodiment the third layer 15 is constructed of polyethylene. The polyethylene provides for a soft comfort and form fitting feel that molds to the head of the wearer. The thickness and type of polyethylene may be varied, pursuant to the needs in the industry, consumer market, and use of the helmet. In the preferred embodiment, a polyethylene layer of ½ inch thickness was determined to be the most effective in absorption and diffusion of linear and rotational impact energy in a uniform manner throughout the helmet 1 and over a larger surface of the wearer's head.

In alternate embodiments, the protective helmet 1 may be made with multiple layers of impact absorbing inner layers, with two, three or more different densities. If desired, an adhesive or an adhesion promoter may be applied at the interface between the layers and the helmet shell 9 to improve adhesion and add to the capability of the helmet 1 to absorb and diffuse linear and rotational impact energy in a uniform manner throughout the helmet 1 and over a larger surface of the wearer's head. Additional pads (not shown) may be added to the inside surface of the helmet 1 for customizing the fit and for spacing the helmet 1 away from the wearer's head for ventilation. The additional pads may be made of a softer open-cell foam material for cushioning and comfort. These pads may be permanently attached to the interior of the helmet 1, for instance with adhesive, or may be adjustably or replaceably positioned by attaching them with hook-and-loop fasteners or similar repositionable fasteners. Ventilation holes 3 through the laminated helmet shell 9 and inner layers 11, 13, 15, provide airflow through the helmet 1. The helmet shell 9 may also be provided with holes or other attachment means for attaching a retention system to fasten the helmet 1 on the rider's head. Suitable retention systems for the protective helmet of the present invention are known in the prior art.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein or in the steps or in the sequence of steps of the methods described herein without departing from the spirit and the scope of the invention as described and set forth in the following claims.

What is claimed is:

1. A safety helmet comprising:

a. a polyethene layer;

b. a gel layer abuttingly contacting the polyethene layer;

c. a polyurethane layer abuttingly contacting the gel layer; and d. a polycarbonate layer abuttingly contacting the polyurethane layer.

2. The safety helmet of claim 1, wherein the gel layer comprises a styrenic block copolymer thermoplastic elastomer.

3. The safety helmet of claim 1 wherein said polycarbonate layer is a polypropylene layer.

4. The safety helmet of claim 1 wherein said polyurethane layer is no less than about ½ inch thick.

5. The safety helmet of claim 1 wherein said gel layer is composed of monoprene gel of no less than about ½ inch thick.

6. The safety helmet of claim 1 wherein said polyethene layer is no less than about ½ inch thick.

7. The safety helmet of claim 1 wherein said the polycarbonate layer is no less than about 1/16 inch thick.

8. The safety helmet of claim 1 wherein said polycarbonate layer is a polypropylene layer no less than about 1/16 inch thick.

9. A safety helmet comprising:

a. a polyethene layer no less than about ½ inch in thickness;

b. a gel layer no less than about ½ inch in thickness, the gel layer abuttingly contacting the polyethene layer, c. a polyurethane layer no less than about ½ inch in thickness, the polyurethane layer abuttingly contacting the gel layer; and d. a polycarbonate layer no less than about 1/16 inch in thickness, the polycarbonate layer abuttingly contacting the polyurethane layer.

10. The safety helmet of claim 9 wherein said polycarbonate layer is polypropylene.

* * * * *

UNITED STATES PATENT AND TRADEMARK OFFICE

CERTIFICATE OF CORRECTION

PATENT NO. : 6,560,787 B2
DATED : May 13, 2003
INVENTOR(S) : Irma Mendoza

It is certified that error appears in the above-identified patent and that said Letters Patent is hereby corrected as shown below:

Column 3,
Line 54, after "a" delete "monoprene" and insert -- tryenic block copolymer thermoplastic elastomer --
Line 58, after "wearer's head." insert -- An example of such A stryenic block copolymer thermoplastic elastomer is MONOPRENE produced by Teknor Apex located in St. Albans, V.T. --

Signed and Sealed this

Fourth Day of November, 2003

JAMES E. ROGAN
*Director of the United States Patent and Trademark Office*